United States Patent [19]

Grehier et al.

[11] Patent Number: 4,612,982

[45] Date of Patent: Sep. 23, 1986

[54] HEAT EXCHANGER OF MODULAR STRUCTURE

[75] Inventors: Alain Grehier, Paris; Alexandre Rojey, Garches; Francois Benoist, Colombes, all of France

[73] Assignee: Institut Francais du Petrole, Rueil-Malmaison, France

[21] Appl. No.: 515,752

[22] Filed: Jul. 21, 1983

[30] Foreign Application Priority Data

Jul. 21, 1982 [FR] France ..... 82 12862

[51] Int. Cl.[4] ..... F28F 3/08

[52] U.S. Cl. ..... 165/166; 165/165; 165/172

[58] Field of Search ..... 165/165, 166, 172, 178

[56] References Cited

U.S. PATENT DOCUMENTS

| | | | |
|---|---|---|---|
| 1,378,130 | 5/1921 | Piette . | |
| 1,430,630 | 10/1922 | Dempsey . | |
| 1,431,486 | 10/1922 | Posnack . | |
| 1,687,236 | 10/1928 | Buffington . | |
| 2,226,320 | 12/1940 | O'Neail . | |
| 2,650,076 | 8/1953 | Hammond | 165/166 |
| 3,399,719 | 9/1968 | Forrest et al. | 165/162 X |
| 3,470,950 | 10/1969 | Menkus | 165/165 |
| 3,476,179 | 11/1969 | Meister et al. | 165/166 |

FOREIGN PATENT DOCUMENTS

| | | | |
|---|---|---|---|
| 70912 | 6/1942 | Czechoslovakia | 165/166 |
| 0117805 | 9/1984 | European Pat. Off. | 165/166 |
| 398796 | 7/1924 | Fed. Rep. of Germany | 165/166 |
| 343666 | 10/1904 | France | 165/148 |
| 717272 | 10/1954 | United Kingdom | 165/166 |
| 2093582A | 9/1982 | United Kingdom | 165/166 |

*Primary Examiner*—Albert W. Davis, Jr.
*Assistant Examiner*—Randolph A. Smith
*Attorney, Agent, or Firm*—Millen & White

[57] ABSTRACT

A heat exchanger of modular structure comprises stacked lattices which can engage with each other, and each is formed of two series of intercrossed small plates jointly assembled by mutual engagement at the level of cuts located on the edges of the plates, with spaces being generated for circulating fluids therethrough in heat exchange relationship.

17 Claims, 19 Drawing Figures

HEAT EXCHANGER OF MODULAR STRUCTURE

BACKGROUND OF THE INVENTION

1. Field of the Invention

The invention relates to a heat exchange device of modular structure, more particularly useful for exchanging heat between several fluids, particularly between two gases.

2. Description of the Prior Art

Tube-and-shell heat exchangers are known. In these devices, one of the fluids taking part in the exchange is passed through the tubes and the other one is passed around the tubes within the shell. The exchange surface per unit volume, called specific surface, which can be obtained with these exchangers is generally limited since, for construction reasons, it is difficult to reduce the diameter of the tubes and the distance between the tubes below about 1 cm.

Plate exchangers can be used to obtain more important exchange specific surfaces. In these exchangers, the fluids which take part in the exchange circulate on both sides of the different plates, but the specific surface is also limited by the necessity to not unduly reduce the distance from plate to plate.

Heat exchangers are also known, which consist of superposed perforated sheets, so juxtaposed as to form channels, by superposition of the perforations; some channels can be used to circulate a relatively hot fluid and some others a relatively cool fluid, the heat transfer between the channels being performed by conduction through the material forming at least part of the sheets.

The heat exchangers are usually made of metallic materials. When a condensation takes place in the course of the heat exchange, as, for example, when recovering heat from the fumes of boilers, these materials are liable to be easily corroded.

SUMMARY OF THE INVENTION

The invention discloses a new heat exchange device whose modular structure (resulting from a mere assembling of elements) allows an easy adaptation to the geometrical requirements to which the user is faced, by making its use in existing systems easy. The posibility to construct this device with quite varied materials also allows its easy adaptation to the nature of the fluids concerned by the heat exchange, particularly when corrosion is liable to occur, for example in heat exchanges with condensation.

The device of the invention also has a high heat exchange specific surface.

The heat exchange structures of the invention can be used to construct exchanger bodies for two fluids circulating in parallel (co-current or counter-current) streams or in crossed streams, as well as the manifolds used to feed and discharge the fluids.

Several exchange bodies can also be associated in different manners to increase, under reduced volume, the path of at least one of the fluids.

The invention makes available a heat exchange device comprising at least one zone of modular structure essentially constituted of stacked lattices which can fit jointly above each other and each formed by the intercrossing of two series of small plates jointly assembled by mutual engagement of the small plates, parallel to each other, of the first series with the small plates, parallel to each other, of the second series, at the level of cuts arranged on one of the edges (for example the upper edge) of the small plates of the first series and on the opposite edge (for example the lower edge) of the small plates of the second series, said stacking creating spaces for circulating at least two fluids in heat exchange relationship.

The invention also discloses a heat exchange device comprising at least one zone of modular structure consisting essentially of a stacking of intercrossed series of small plates jointly assembled by mutual engagement of the small plates, parallel to each other, of a series with the small plates, parallel to each other, of the subsequent series, at the level of cuts arranged on the two edges of each small plate, facing each other; said stacking of series of small plates creates spaces for circulating at least two fluids in heat exchange relationship.

BRIEF DESCRIPTION OF THE DRAWINGS

The invention will be described hereinafter in relation to the annexed drawings, wherein.

DESCRIPTION OF THE PREFERRED EMBODIMENTS

A first heat exchange structure according to the invention consists essentially of a stacking of lattices (or grids) which can fit above each other and formed each by the intercrossing of two series of small plates, assembled by mutual engagement of each small plate of a series with the small plates of the other series. The small plates of the first series, parallel to each other, consist of so-called "solid" small plates, i.e. only comprising, on one of their edges, the cuts necessary to the engagement with the small plates of the second series; said small plates of the second series are parallel to each other and arranged preferably perpendicularly to the small plates of the first series; they can consist, depending on the case, of "solid" small plates, as those of the first series, or of so-called "perforated" small plates, i.e. comprising, in addition to the cuts necessary to the engagement with the small plates of the first series, on one of their edges, holes arranged in some of the solid parts of the small plates limited by two consecutive cuts, said holes being placed, for example, in every other solid part. The stacking of the lattices creates circulation spaces for at least two fluids in heat exchange relationship.

In the present disclosure, the word "lattice" thus designates a grid formed by the intercrossing of small solid plates of a first series, parallel to each other, with small plates of a second series, solid or perforated, parallel to each other. When considering the lattice (or grid) in horizontal position, the two series of small plates take place in two series of vertical planes parallel to each other, each plane of one of the two series crossing the planes of the other series along dihedral angles of vertical apex, equal to each other. These dihedral angles are preferably of 90°.

To perform the engagement of the various lattices above each other, there is used, in conformity with the invention, an alternate stacking of lattices of two different types, as hereinafter described.

An embodiment of this first heat exchange structure of the invention is described hereinafter, in relation with the FIGS. 1 to 4.

This first embodiment of a structure according to the invention can correspond to an exchange zone wherein two fluids can circulate in crossed streams.

Figure 1:
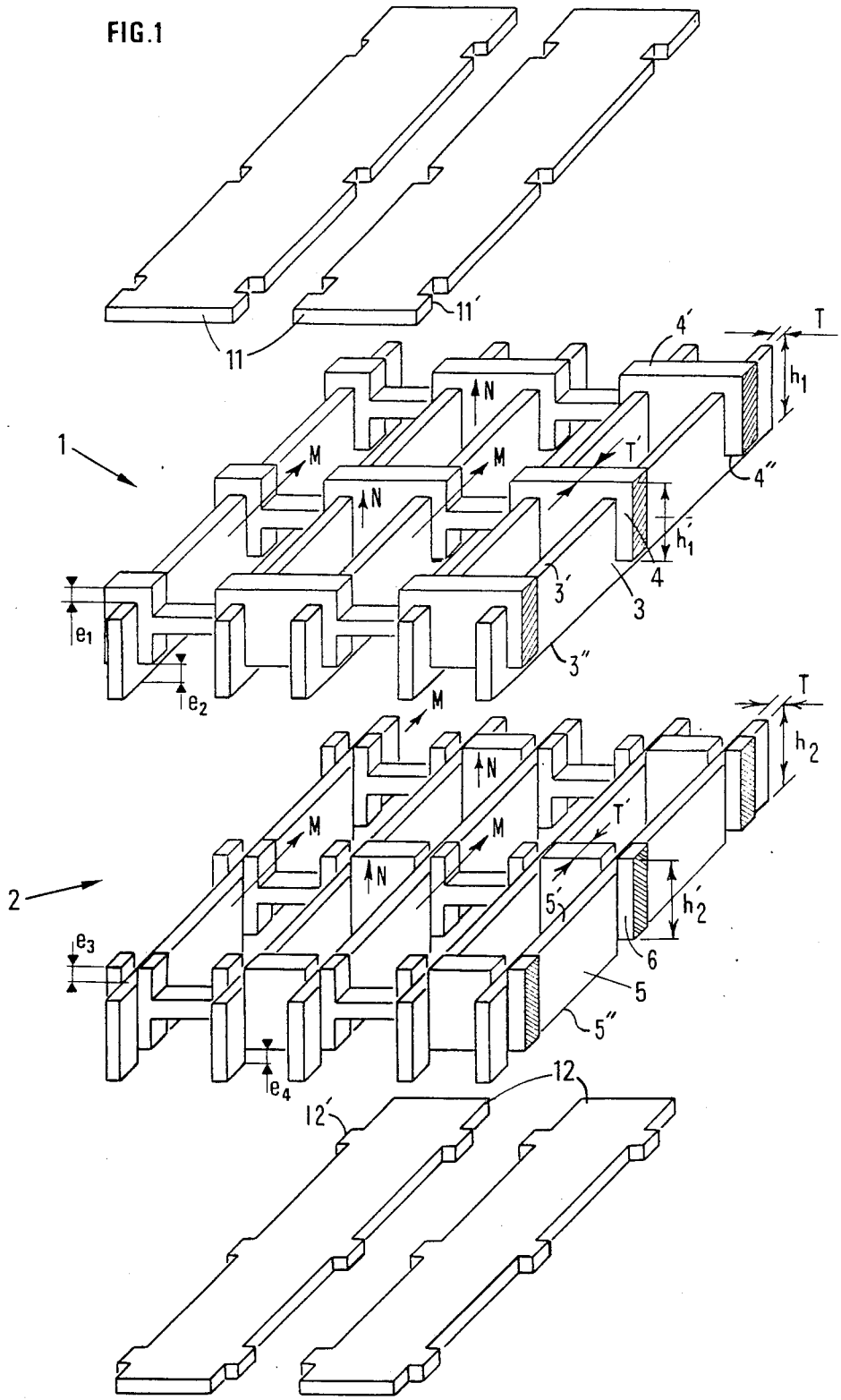
FIG. 1 shows in perspective two lattices of different types constituting a first embodiment of a heat exchange structure conforming to the invention.
Figure 2A:
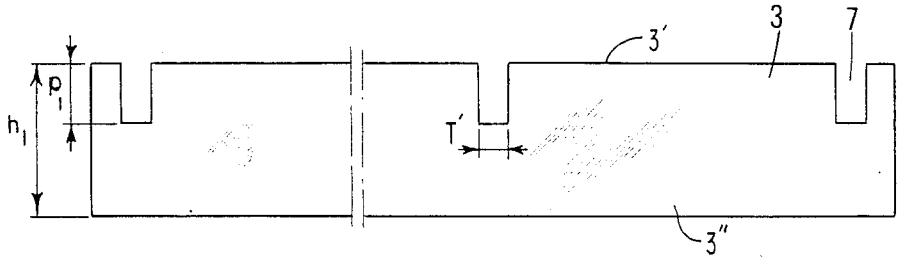
FIGS. 2A and 2B show front views of two small plates constituting a first type of lattice.
Figure 2B:
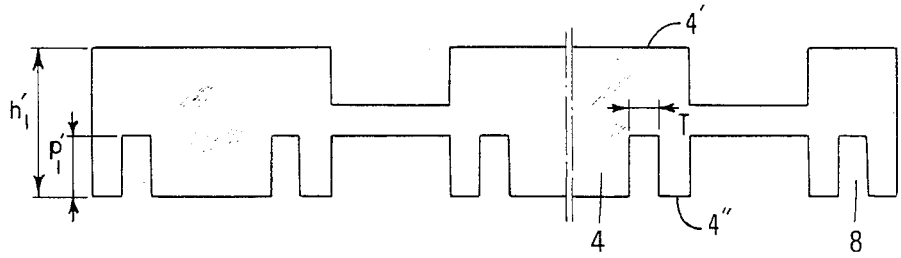

As illustrated, for example, in FIG. 1, the lattices of first type 1 is formed of an intercrossing of two series of small plates, a series of solid small plates 3 and a series of perforated small plates 4, which are also shown in FIGS. 2A and 2B. The cuts 7 of the small plates of the first series 3 are arranged, for example, along the upper edge 3' of said small plates. They all have preferably the same depth $P_1$ and their width is equal or substantially equal to the thickness T' of the small plates of the second series. Symetrically, the cuts 8 of the small plates of the second series 4 are arranged, for example, along the lower edge 4'' of said small plates. They all have preferably the same depth $P_1'$ and then width is equal or substantially equal to the thickness T of the small plates of the first series 3.

The holes within the perforated small plates 4 may have any size: they can be circular, square, rectangular, etc . . . they can open, or not, on one edge of the small plate. They can also consist of several disjoined holes on each small plate, one or more of them opening, or not, on an edge or on the two edges of the small plate. FIGS. 4A to 4D show different shapes and particular arrangements of these holes.

The assembling of the two series of small plates 3 and 4 is performed when each cut 8 of the lower edge 4'' of the small plates of the second series 4 engages with a cut 7 of the upper edge 3' of the small plates of the first series 3. There is thus obtained a rigid or substantially rigid lattice (lattice of type 1).

Figure 3A:
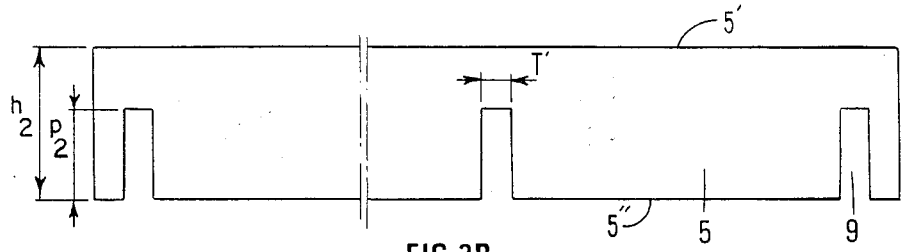
FIGS. 3A and 3B show front views of two small plates constituting a second type of lattice.
Figure 3B:
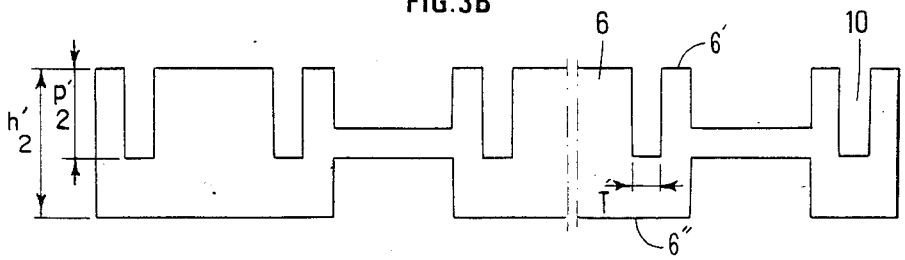
Figure 4A:
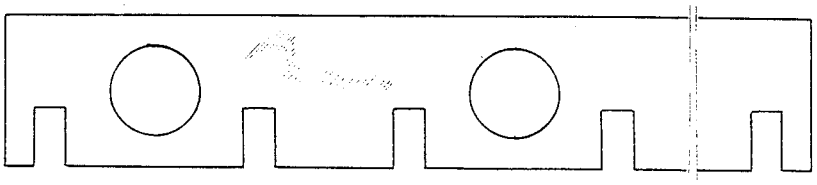
FIGS. 4A–4D show front views of small plates bearing holes of different shapes, given as examples.
Figure 4B:
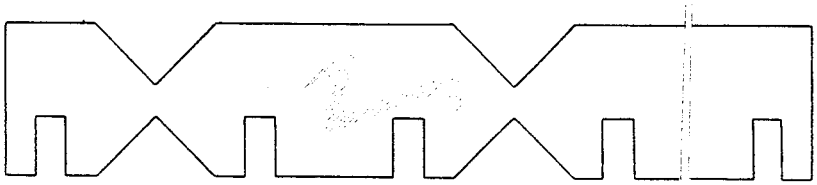
Figure 4C:
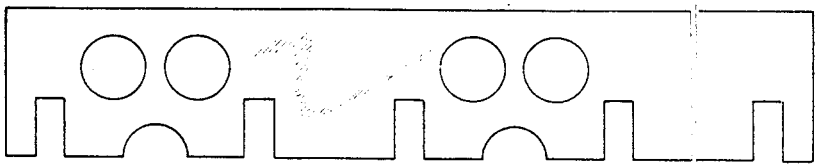
Figure 4D:
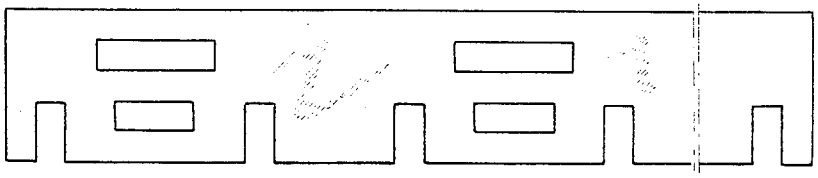

FIG. 1 shows a lattice of a second type 2, also formed by the intercrossing of two series of small plates: a series of solid small plates 5 and a series of perforated small plates 6, which are also shown in FIGS. 3A and 3B.

The cuts 9 of the small plates of the first series 5 are arranged, for example, along the lower edge 5'' of said small plates. They have all preferably the same depth $P_2$ and their width is equal or substantially equal to the thickness T' of the small plates of the second series. Symetrically the cuts 10 of the small plates of the second series 6 are arranged for example along the upper edge 6' of said small plates. They all have preferably the same depth $P_2'$ and their width is equal or substantially equal to the thickness T of the small plates of the first series 5.

In the same manner as relates to the lattice of the first type 1, the holes of the perforated small plates 6 of the lattice 2 may have various shapes and arrangements.

The assembling of the two series of small plates 5 and 6 is terminated when each cut 9 of the lower edge 5'' of the small plates of the first series 5 engages with a cut 10 of the upper edge 6' of the small plates of the second series 6. There is thus obtained a rigid or substantially rigid lattice (lattice of the type 2).

The heat exchange structure of the invention is formed of an alternate stacking of lattices of the type 1 and the type 2, the lower side of each lattice of type 1 engaging (as results from FIG. 1) with the upper side of a lattice of type 2. The lower side of each lattice of type 2 can also engage with the upper side of a lattice of type 1, not shown in FIG. 1.

To make the drawing clearer, only two lattices have been shown in FIG. 1, each formed of a small number of small plates; it is however understood that a stacking of lattices constituting a heat exchange zone according to the invention can consist of a great number of superposed lattices, from about ten to several hundreds, and that each lattice can comprise a great number of intercrossed small plates (from about ten to several hundreds).

FIG. 1 also shows obturating end plates 11 and 12 whose operation will be explained hereinafter. In essence the end plates 11 and 12 form horizontal channels to direct heat transfer fluid in the direction M which is perpendicular to the direction N between every other pair of walls formed by alternating superposition of plates 3 and plates 5.

To engage a lattice of type 1 with a lattice of type 2, the emergence $e_2$ of the projecting (lower) edges 3' of the series of small plates 3 of the lattice 1 is made to correspond with the depression $e_3$ of the sunk (upper) edges 5' of the series of homologous small plates 5 of the lattice 2.

In the same manner, the depression $e_4$ of the sunk (lower) edges 6'' of the series of small plates 6 of the lattice 2 is made to correspond with the emergence $e_1$ of the projecting (upper) edges 4' of the series of small plates 4 of a lattice of type 1 located below the lattice of type 2.

In other words, the respective heights $h_1$ and $h_1'$ of the small plates 3 and 4 and the respective depths $p_1$ and $p_1'$ of the cuts 7 within the small plates 3 and of the cuts 8 within the small plates 4 are so selected that the bottoms of said cuts 7 and 8 coming into contact when engaging the two series of small plates 3 and 4 limit the mutual over-lapping of said small plates, so that for example the edges 4' of the perforated small plates 4 opposite to the edges 4'' bearing the cuts 8 are located in the most external (in emergence) plane of the upper side of a lattice of type 1; whereas the edges 3'' of the solid small plates 3 opposite to the edges 3' bearing the cuts 7 are located in the most external (in emergence) plane of the lower side of the same lattice 1.

On the other hand, as far as the lattices of type 2 are concerned, the respective heights $h_2$ and $h_2'$ of the small plates 5 and 6 and the respective depths $p_2$ and $p_2'$ of the cuts 9 within the small plates 5 and of the cuts 10 within the small plates 6 are so selected that the bottoms of said cuts 9 and 10, coming into contact when engaging the two series of small plates 5 and 6, limit the mutual overlapping of said small plates, so that, for example, the edges 6'' of the perforated small plates 6 opposite to the edges 6' bearing the cuts 10 are located in the most internal (recessed) plane of the lower side of the lattice 2; whereas the edges 5' of the solid small planes 5 opposite to the edges 5'' bearing the cuts 9 are located in the most internal (recessed) plane of the upper face of the same lattice 2.

In addition, the heights $h_1$, $h_1'$, $h_2$ and $h_2'$ of the small plates 3, 4, 5 and 6 and the depths $p_1$, $p_1'$, $p_2$ and $p_2'$ of the cuts 7, 8, 9 and 10 are so selected that the emergence $e_2$ for lattice 1 of the plane of the edges 3'' of the small plates 3 opposite to the edges 3' bearing the cuts 7, with respect to the plane of the edges 4'' of the small plates 4 bearing the cuts 8, is equal to the depression $e_3$ for lattice 2, of the plane of the edges 5' of the small plates 5 opposite to the edges 5'' bearing the cuts 9, with respect to the plane of the edges 6' of the small plates 6 bearing the cuts 10; also, taking the alternance of the lattices of type 1 and type 2 in the stacking into account, the heights $h_1$, $h_1'$, $h_2$ and $h_2'$ of the small plates 3, 4, 5 and 6 and the depths $p_1$, $p_1'$, $p_2$, $p_2'$ of the cuts 7, 8, 9 and 10 are so selected that the depression $e_4$ for lattice 2 of the plane of the edges 6'' of the small plates 6 opposite to the edges 6' bearing the cuts 10 with respect to the plane of the edges 5'' of the small plates 5 bearing the cuts 9, is equal to the emergence $e_1$ for the lattice of type 1, placed below the lattice 2, of the plane of the edges 4' of the small plates 4 opposite to the edges 4'' bearing the cuts 8 with respect to the plane of the edges 3' of the small plates 3 bearing the cuts 7.

The characteristics defined above show that the different stacked lattices engage with each other and that, in this engagement, the projecting (or depressed) parts of one of the sides of a lattice of the first type come into contact with the homologous depressed (or projecting) parts of the opposite side of the lattice of the second type.

The above considerations lead to the following relations between the "emergences", respectively $e_2$ and $e_1$, of a lattice of type 1 and the "depressions", respectively $e_3$ and $e_4$, of a lattice of type 2:

$$e_2=e_3 \text{ leads to } (h_1-p_1)-p_1'=p_2'-(h_2-p_2) \quad (1)$$

and $$e_1=e_4 \text{ leads to } (h_1'-p_1')-p_1=p_2-(h_2'-p_2') \quad (2)$$

with $p_1<h_1$ $p_1'<h_1'$ $p_2<h_2$ and $p_2'<h_2'$

These relations (1) and (2) can also be written:

$$p_1+p_1'+p_2+p_2'=h_1+h_2 \quad (3)$$

$$p_1+p_1'+p_2+p_2'=h_1'+h_2' \quad (4)$$

In the alternate stacking of lattices of type 1 and type 2 constituting a heat exchange structure conforming to the invention, the heights of the various small plates are so selected that the aggregate heights $h_1$ and $h_2$ of the solid small plates 3 and 5 are equal to the aggregate heights $h_1'$ and $h_2'$ of the perforated small plates 4 and 6. In addition, the respective depths $p_1$, $p_1'$, $p_2$ and $p_2'$ of the cuts 7, 8, 9 and 10 are so selected as to have the above aggregate value ($h_1+h_1'$ or $h_2+h_2'$).

According to a particular embodiment of the above structure, presenting the advantage of a greater simplicity, the selected small plates have all the same height H.

The above relations (1) and (2) between the "emergences" and the "depressions" corresponding to the two types of lattices become identical:

$$H-p_1-p_1'=p_2'-H+p_2 \quad (5)$$

The relations (3) and (4) also become identical:

$$p_1+p_1'+p_2+p_2'=2H \quad (6)$$

When considering now the relation (5), it appears that, in the case of a height H common to the different small plates, the emergences $e_2$ of, for example the solid, small plates 3 on the lower side of a lattice of the first type (such as 1), equal to the depressions $e_3$ of the solid small plates 5 on the upper face of a lattice of the second type (such as 2) are also equal to the emergences $e_1$ of the perforated small plates (4) on the upper face of a lattice of the first type placed, for engagement thereof, above a lattice 2, themselves equal to the depressions $e_4$ of the perforated small plates 6 on the lower side of a lattice such as 2. Designating as E the common value of the emergences and the depressions of the two types of lattice, the relation (5) leads to the relations:

$$p_1+p_1'=H-E \quad (7)$$

and $$p_2+p_2'=H+E \quad (8)$$

In that case, selecting now a determined value for E, the values to be attributed to the depths $p_1$ and $p_1'$ of the respective cuts 7 and 8 of the small plates 3 and 4 must be selected from those satisfying the relation (7), and the values to be attributed to the depths $p_2$ and $p_2'$ of the respective cuts 9 and 10 of the small plates 5 and 6 must be selected from those satisfying the relation (8).

Thus, for example, if the height H of the small plates is 25 mm and if it is desired that the emergences and the depressions of the various lattices to be engaged above each other have the value E=5 mm, the depths of the cuts must be such that:

$$p_1+p_1'=25-5=20 \text{ mm}$$

and $$P_2+p_2'=25+5=30 \text{ mm}$$

The following values (in mm) can, for example, be adopted:

| $p_1$ | $p_1'$ | $p_2$ | $p_2'$ |
|---|---|---|---|
| 5 | 15 | 5 | 25 |
| 10 | 10 | 10 | 20 |
| 10 | 10 | 15 | 15 |
| 15 | 5 | 15 | 15 |
| 15 | 5 | 20 | 10 |

It can be checked in all cases that the total value of the cut depths is well 2H, i.e. 50 mm.

According to a particular embodiment, the depth of the cuts within the small plates of a same lattice can be selected to be common. This will give, for example:

$p_1=p_1'=P_1$ for the small plates 3 and 4 and $p_2=p_2'=P_2$ for the small plates 5 and 6.

The following relations are obtained, for a common value of emergence or depression E:

$$P_1 = \frac{H - E}{2} \text{ and } P_2 = \frac{H + E}{2}$$

with $P_1 + P_2 = H$

Taking again the above practical example, the value of $p_1$ and $p_1'$ will be selected of 10 mm and that of $p_2$ and $p_2'$ of 15 mm.

A heat exchange zone having the structure defined above is thus built by stacking lattices, the lattices having projecting plate edges on their two sides alternating with lattices having depressed plate edges on their two sides, the projecting parts of a lattice engaging into the depressed parts of the next (lower or upper) lattice. It is thus possible to stack any number of lattices of the two types. In this stacking, the superposed solid small plates constitute continuous walls from one end to the other end of the stacking, these walls being parallel to each other. The stacking of the perforated small plates, whose planes, parallel to each other, cut the planes constituted, by the stacking of the solid small plates, for example at right angle thereto, creates on the one hand elements of a continuous wall, when considering the superposition of the solid parts of said perforated walls, and on the other hand elements of a perforated wall, when considering the superposition of the perforated parts of said perforated small plates, the elements of continuous wall alternating with the elements of perforated wall, each element of a wall of one of the two types being separated from the next element of wall of the other type by a continuous adjacent wall corresponding to the superposition of the solid small plates.

The above walls thus determine two types of spaces for circulating the fluids to be put into heat exchange relationship. As a matter of fact, all the solid walls formed by superposing solid small plates, and parallel to each other, separate spaces which, with respect to the whole exchange structure (the stacking of lattices), appear as sections. Since the solid elements and the perforated elements alternate on the walls formed by superposition of the perforated small plates, the sections defined above are alternately of two different types. The ones are subdivided into channels, of for example rectangular or square cross-section, separated by solid elements; the other sections are not subdivided into separate channels, since the holes of the perforated elements constitute passages from a channel to the next channel.

The separate channels delineated in the various spaces (or sections) are generally traversed by a first fluid taking part in the heat exchange. The fluid then circulates in a direction parallel to the planes of the small plates (i.e. parallel to the planes of the walls) constituting the exchange zone.

A second fluid is circulated through the spaces (or sections) not subdivided into separate channels. The fluid can flow through each of these sections throughout while passing through the junction passages constituted by the holes that it meets, the remainder of the solid parts surrounding the holes constituting blades or deflectors. In these sections, the fluid circulates in a direction substantially perpendicular, as an average, to the perforated wall elements and parallel to the solid walls. Under these conditions, the two fluids circulate in crossed streams.

The ends of the spaces (or sections) wherethrough the second fluid is circulated, located on the sides of the stacking destined to the input and the output of the first fluid are closed, for example, by plates (such as 11 and 12, FIG. 1) engaging on the first (and the last) lattice of the stacking, these plates overlapping one space out of two, the spaces remaining open corresponding to the input (or the output) of said first fluid. The openings of the sections wherethrough the second fluid is flowed on the sides of the stacking destined to the input and the output of said second fluid are materialized de facto by the holes in the perforated small plates constituting said sides. On the other hand, the walls of the end channels of each space (or section) wherethrough the first fluid is circulated, opening on the sides of the stacking destined to the input and the output of the second fluid, are obturated de facto by the solid parts of the perforated small plates whose superposition constitutes said sides. Finally, the two end sides of the stacking through which none of the two fluids goes in or goes out are themselves obturated de facto by the continuity of the walls by the superposition of the end solid small plates of the various lattices of the stacking.

The structure of heat exchanger such as hereinbefore described can constitute the exchange body of an exchanger destined to the circulation of two fluids in crossed streams, one of the fluids, for example fumes, flowing through the separate channels downwardly or upwardly and the other fluid, for example air to be heated, then circulating from a lateral side towards the opposite side. In that case, the means for supplying and discharging fluids can consist of usual means, particularly of cylindrical ducts which are attached in appropriate manner on the sides of the exchange body through which each of the fluids concerned must be fed or discharged. These means have not been shown in FIG. 1.

In summary, the afore-described heat exchange device of modular structure is constituted essentially by elemental pieces comprising pairs of stacked lattices, such as the lattices 1 and 2 shown in FIG. 1. The lattices jointly engage one above the other and are each formed by intercrossing two series of separate small plates, such as two series of separated intercrossed small plates 3 and 4 forming lattices 1, and two series of separate intercrossed small plates 5 and 6 forming lattices 2 shown in FIG. 1. The series of first plates 3 for constituting lattices 1 have predetermined lateral heights $h_1$ and thicknesses T and are arranged in spaced parallel rows extending in a first direction. The series of first plates 3 have upper edges 3' and lower edges 3'' wherein the upper edges 3' have a plurality of spaced notches 7 (FIG. 2*a*) therein each of a predetermined depth $p_1$ and width T'. The series of second plates 4 for constituting lattices 1 have a predetermined lateral height $h_1'$ and thicknesses T'. The thicknesses T' of the second plates 4 complements the widths of the notches 7 in the first plates 3. The second plates 4 are arranged in second, spaced-parallel rows extending in a second direction normal to the direction in which the first plates 3 extend. Each of the second plates 4 has an upper edge 4' and a lower edge 4'' with the lower edges having spaced notches 8 therein each of a depth $p_1'$ and a width complementing the thickness T of the first plates 3. The series of second plates 4 nest within the series of first plates 3 with the notches 8 of the second plates 4 being aligned with one another and interlocking with the notches 7 of the first plates 3. As is seen in FIGS. 1, 2A and 2B, due to the heights $h_1$ and $h_1'$ and to the depths $p_1$ and $p_1'$ the bottom edges 3'' of the first plates 3 extend below the bottom edges 4″ of the second plates 4 by a distance $e_2$ and the top edges 4′ of the second plates 4 extend above the top edges 3′ of the first plates 3 by a distance $e_1$. With the plates 3 and 4 thus nested, the lattice 1 is created so as to nest with the complementary stacked lattice 2 described hereinafter in order to form an elemental piece of the heat exchange device.

The two series of plates 5 and 6 forming the lattice 2 comprises a series of third plates 5 having a predetermined lateral height $h_2$ and a predetermined thickness T and being arranged in the same direction as the first plates 3. The series of third plates 5 have upper edges 5′ and lower edges 5″, the lower edges 5″ having a plurality of spaced notches 9 therein each of a width complementing the thickness T′ of the second plates 4 of the lattice 1 and of a predetermined depth $p_2$. The second lattice 2 also includes a series of fourth plates 6 each having a predetermined lateral height $h_2'$ and a predetermined thickness T′. The fourth plates 6 are arranged in the same direction as the second plates 4. Each of the fourth plates 6 has an upper edge 4′ and a lower edge 4″, the upper edges 4′ having notches 10 therein of a width complementing the thickness T of the first and third plates 3 and 5 and a predetermined depth substantially equal to the distance between the upper edge 5′ of the third plates 5 and the bottom of the notches 9 of the third plates plus the distance $e_2$ that the first plates 3 project beyond the bottom edge 4″ of the second plates 4 when the first and second plates 3 and 4, respectively are nested with one another. The lattices 1 and 2 therefore nest with one another with the top edges 5′ and 6′ of plates 5 and 6 in abutment with the bottom edges 3″ and 4″ of the upper plates 3 and 4, respectively.

As is seen in FIG. 1, the lattice 2, consisting of the third and fourth plates 5 and 6 has a bottom surface configured to receive and nest with the upper surface of lattice 1 consisting of plates 3 and 4 since the second plates 4 project above the top edge 3′ of the first plates 3 by a distance $e_1$ which is equal to the distance $e_4$ that the third plates 5 projects beneath the lower edge 6″ of the fourth plates 6.

The fifth and sixth plates 11 and 12, which are end plates of a heat exchange device according to this invention, extend horizontally in a direction normal to the plates 3, 4, 5 and 6 of the lattices 1 and 2. The end plate 11 has notches 11′ therein which accommodate the thickness T′ of the second plates 4 and close the gap between every other pair of first plates to form transverse channels. The sixth end plates 12 have projections 12′ which are received in the notches 9 of the third plates 5 to cover the space between every other pair of third plates to form transverse channels. Consequently, the fifth and sixth end plates 11 and 12 cooperate with the plates 3 and 5 to close channels M which direct fluid flow in a direction perpendicular to the fluid flow through open channels N between plates 3 and plates 5 (see the structure 17 and 18 of FIG. 7).

A second embodiment of the first heat exchange structure according to the invention described above can consist essentially, as the first mode, of a stacking of lattices (or grids) which can engage on one another, and each formed of an intercrossing of two series of small plates, assembled by mutual engagement of each small plate of a series with the small plates of the other series. However, differing from the first embodiment, the two series of small plates whose intercrossing forms each of the lattices are both constituted of solid small plates. The description of this second embodiment will thus be analogous to that of the first embodiment, provided the "perforated" small plates are replaced by "solid" small plates.

This second embodiment is described hereinafter in relation to the FIGS. 5, 6A and 6B.

The considered structure consists of an alternate stacking of of any number of lattices such as 13 and 14. The engagement of these lattices is performed in the same way as for the first embodiment: the projecting (or depressed) parts of a lattice, for example of the first type (such as 13), are made to correspond with the depressed (or projecting) parts of a lattice of the second type (such as 14), located below or above said lattice of the first type.

Since all the small plates constituting the lattices (of the first or second type) engaged on each other are solid small plates, in the stacking of the lattices constituting the contemplated structure, no more distinction will be made between the spaces (or sections) divided into separate channels and the spaces (or sections) not subdivided into separate channels but comprising paths constituted by the holes in the perforated small plates as is the case in the first embodiment. In the present embodiment, the stacking of the lattices constituted only of solid small plates will only comprise channels, all separated from each other by solid walls resulting from the superposition of the solid parts of the homologous small plates.

This structure can constitute the body of a heat exchanger wherethrough, for example, two fluids circulate in parallel streams (co-currently or counter-currently).

The distribution of the channels destined to the circulation of the first fluid and those destined to the circulation of the second fluid can be so selected that, with the exception of the channels next to the external walls of the exchange zone, each channel wherethrough circulates one of the two fluids is contiguous to at least two channels wherethrough circulates the other fluid. Examples of these distributions are given in FIGS. 6A and 6B.

Figure 6A:
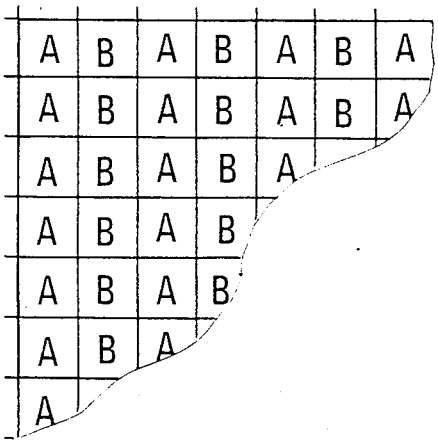
FIGS. 6A and 6B show possible arrangements of channels for circulating two fluids in heat exchange relationship.

When the heat exchange structure constituted of parallel channels, such as described above, presents the distribution of the circulations of fluids represented in FIG. 6A, a particularly advantageous aspect of the invention consists of making the exchange zone open at each end on heads for supplying and discharging fluids, each conceived analogously to the first embodiment described above (cross-streams circulation).

This particular embodiment of a heat exchanger according to the invention is described hereinafter in greater detail in relation to the FIGS. 7, 8A, 8B, and 8C.

Figure 7:
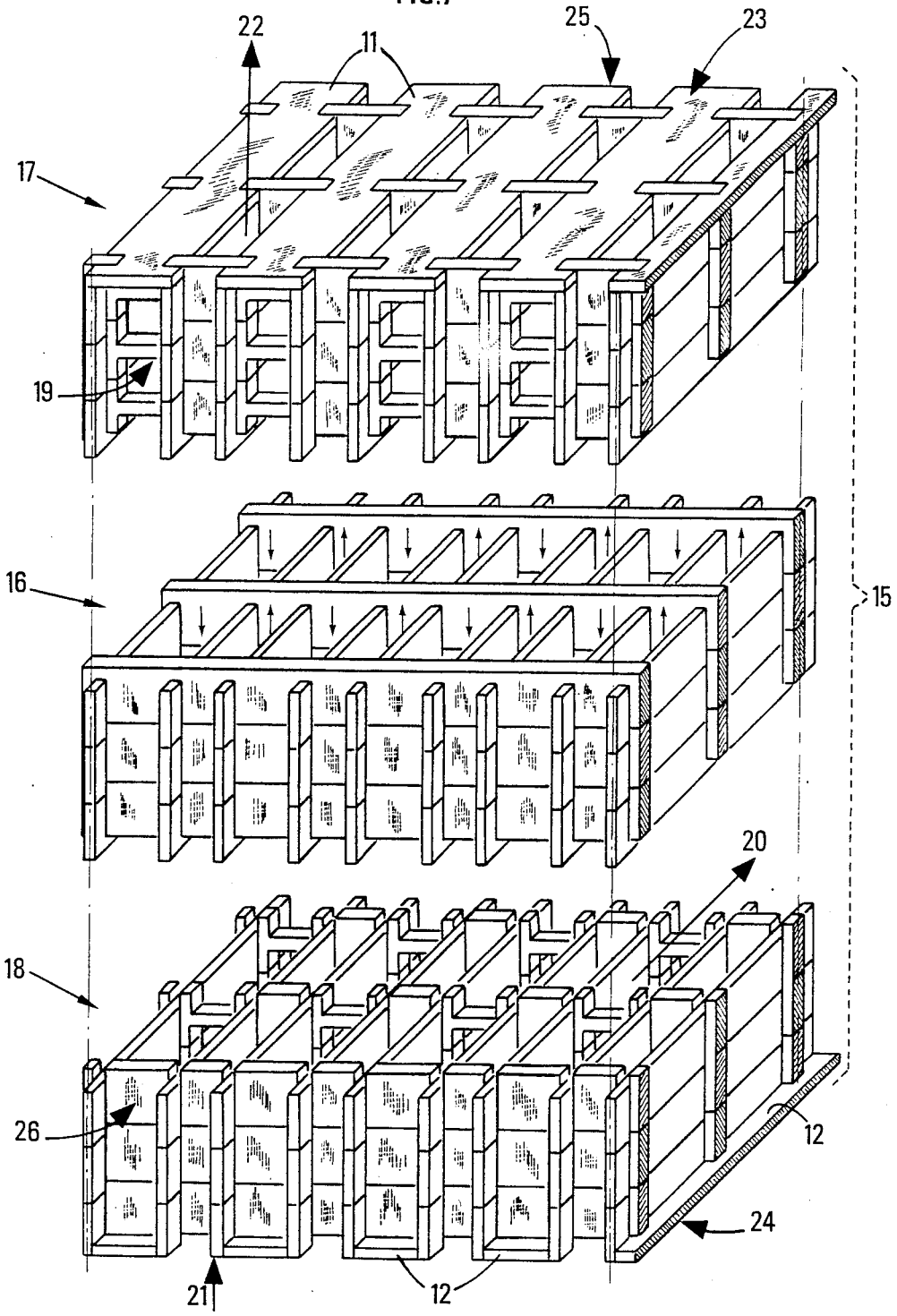
FIG. 7 represents, in perspective, a heat exchanger according to the invention, formed of a central body and two manifolds at its ends.

Such as represented in FIG. 7, the heat exchange device 15 comprises a central body 16 and two manifolds 17 and 18. The central body appears as a parallepiped of rectangular or square base, formed, by the stacking of the lattices which constitute it, of a determined number of rows of channels of rectangular or square cross-section, each row comprising a determined number of channels.

The manifolds 17 and 18 consist each of a stacking of several lattices analogous to those of FIG. 1, which consist of intercrossings of solid small plates and perforated small plates assembled by mutual engagement of said small plates at the level of cuts within the edge of the latter. The perforated small plates comprise holes arranged alternately, one out of two, in the parts of said small plates located between two subsequent cuts. A second fluid can be fed, for example, in the direction of the arrows 19, through the holes of the perforated small plates levelling on the contemplated side, in spaces (or sections) crossing the manifold 17. These spaces are closed on the upper side 23 of the manifold 17 by plates such as 11 (FIG. 1) which engage into the upper lattice, the remaining open spaces corresponding to the rows of channels through which the first fluid is discharged along the arrow 22. The spaces traversed by said second fluid are also closed on the side of the collector 17 opposite to the input side, by substitution of a solid small plate to the end perforated small plate of each of the lattices whose stacking constitutes said manifold 17, the superposition of these solid small plates constituting a continuous wall 25 (not shown in FIG. 7). The spaces wherethrough circulates said second fluid are, at the junction of the manifold 17 with the central body 16, in communication with the corresponding channel rows, the plates such as 12 (represented in FIG. 1) being obviously omitted in the present case. The channel rows of the manifold 17, through which the second fluid is discharged, communicate with the homologous channel rows of the central body 16.

The manifold 18 located, for example, at the bottom of the central body 16, can be described analogously. The second fluid is discharged, for example in the direction of the arrows 20, through the holes of the perforated small plates levelling on the contemplated side, outside of the spaces (or sections) traversing the manifold 18 and separate from each other by rows of channels through which is fed the first fluid along the direction of the arrows 21. These spaces (or sections) are closed on the lower side 24 of the manifold 18 by plates analogous to the plates 12 (see FIG. 1), which engage into the lower lattice of the manifold 18, the spaces remaining open on that side corresponding to the rows of channels through which said first fluid is fed. The spaces wherethrough circulates said second fluid are also closed on the side of the manifold 18 opposite to the outlet side, by substitution of a solid small plate to the end perforated small plate of each of the lattices whose stacking constitutes the manifold 18, the superposition of these solid small plates constituting a continuous wall 26. The spaces traversed by said second fluid communicate, at the junction of the manifold 18 with the central body 16, with the corresponding channel rows, the plates such as 11 (represented in FIG. 1) being obviously omitted in the present case. The channel rows of the manifold 18 through which the first fluid is fed communicate with the rows of homologous channels of the central body 16.

The circulation of the two fluids within the device shown in FIG. 7 is thus performed in counter-current in the central body 16. A circulation of the fluids in co-current is also possible, as well.

Figure 8A:
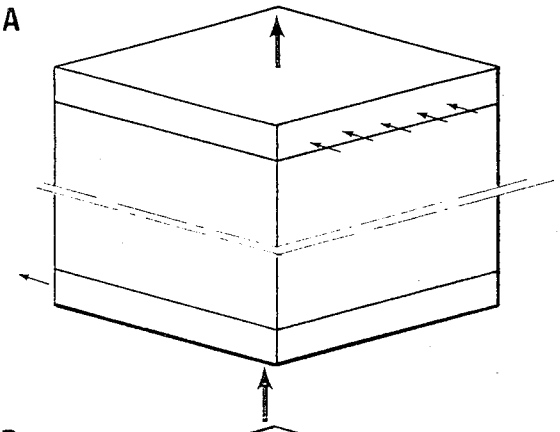
FIGS. 8A, 8B and 8C show schematically various possible relative arrangements for the central body and the two manifolds.
Figure 8B:
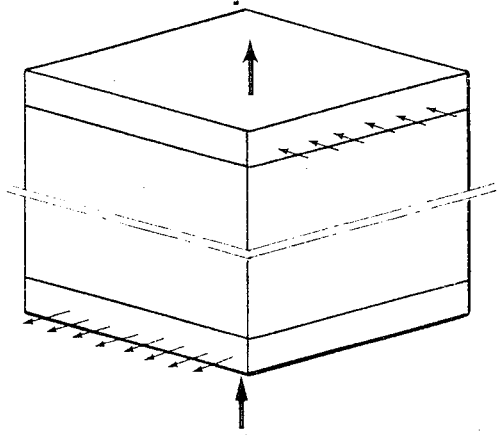
Figure 8C:
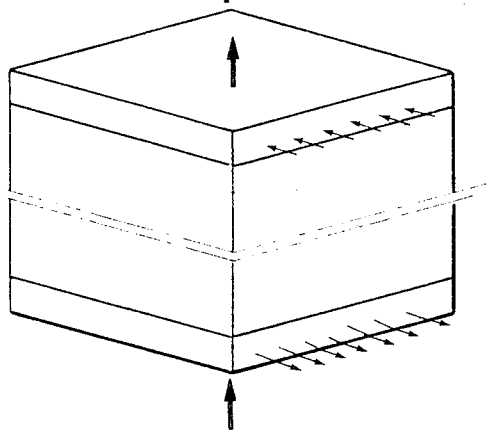

On the other hand, the relative arrangement of the sides of the manifolds 17 and 18, through which the first fluid is supplied or discharged, can be modified, as shown in the drawings of the FIGS. 8A, 8B and 8C.

It is also possible, according to the invention, to associate two or more devices analogous to the exchanger 15 described above.

The exchangers can be serially associated so as to extend the path followed by one of the fluids or by the two fluids.

Figure 9:
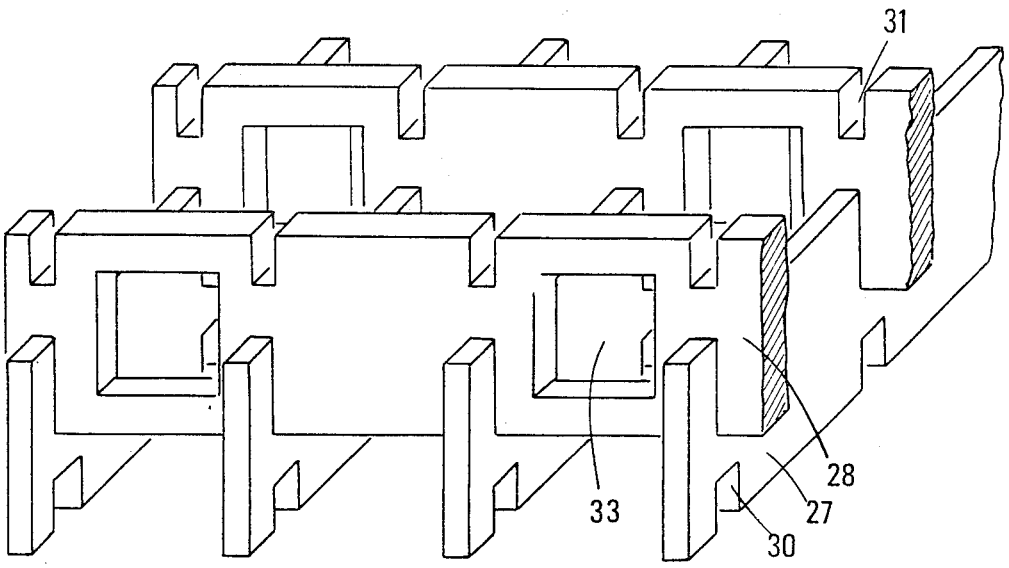
FIG. 9 shows in perspective a small plates arrangement according to another structure of the invention.
Figure 10A:
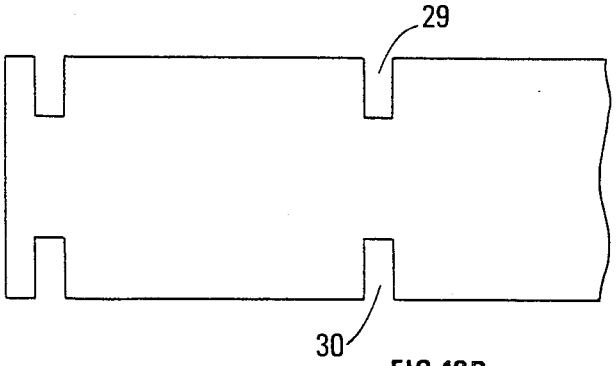
FIGS. 10A and 10B represent front views of two types of small plates constitutive of this structure.
Figure 10B:
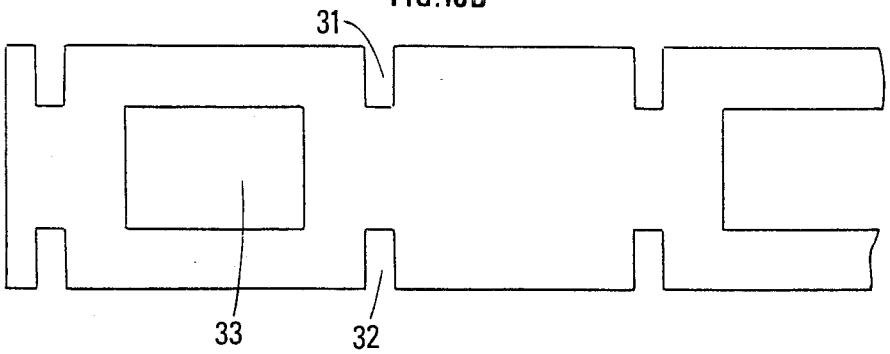

A second heat exchange structure according to the invention is described hereinafter in relation with the FIGS. 9, 10A and 10B.

Said second structure of heat exchange consists of a stacking of series of intercrossed small plates, assembled above each other by mutual engagement of each small plate (such as 27, FIG. 9) of a series with the small plates (such as 28, FIG. 9) of another series, placed for example above the small plates of the preceding series. The small plates of each series, parallel to each other, comprise cuts on their two edges (respectively 29, 30, 31 and 32) facing each other, destined the ones (the lower cuts) to perform the assembling by mutual engagement with the cuts of the upper edge of the small plates, parallel to each other, of the series located thereunder, the other ones (the upper cuts) destined to perform the assembling by mutual engagement with the cuts of the lower edge of the small plates, parallel to each other, of the series located above. The planes of the small plates of the even series cross the planes of the small plates of the odd series, at the level of their respective cuts, by forming dihedral angles of vertical apex (when considering a stacking wherein small plates are in vertical planes); these dihedral angles, all identical, are preferably of 90° (the intercrossing of the series of small plates is performed in right angle).

The cuts of a same edge of the small plates of a series have the same depth and all the cuts of the small plates of the series of same order (even or odd) have the same width, equal or substantially equal to the thickness of the small plates of the series of the other order (odd or even).

In this second heat exchange structure according to the invention, the small plates of the odd series (such as 27) and the small plates of the even series (such as 28) have all the same height h.

On the other hand, designating the respective depths of the cuts 29, 30, 31 and 32 of the small plates 27 and 28 as $p_3$, $p_3'$, $p_4$ and $p_4'$, the tight assembling of the series of small plates above each other supposes that the relation $$h-(p_4+p_4')=(p_3+p_3')$$

be satisfied.

Thus, for example, when selecting for the small plates of the two series a common height of 40 mm, the values given in the following Table can be given to the various cut depths:

| $p_3$ | $p_3'$ | $p_4$ | $p_4'$ |
|---|---|---|---|
| 5 | 5 | 15 | 15 |
| 10 | 5 | 10 | 15 |
| 10 | 10 | 10 | 10 |
| 10 | 10 | 5 | 15 |

Any number of series of small plates can be assembled above each other, for example, from a few tens to several hundreds.

The small plates of, for example, the odd series (such as 27) are small plates called "solid", i.e. comprising only the cuts necessary to their assembling with the small plates of the even series located immediately above or below. The small plates of, for example, the even series (such as 28) can be "solid", as the above small plates 27, or "perforated", i.e. comprising perforations alternating in one out of two of the solid parts delimited by two consecutive cuts.

Figure 5:
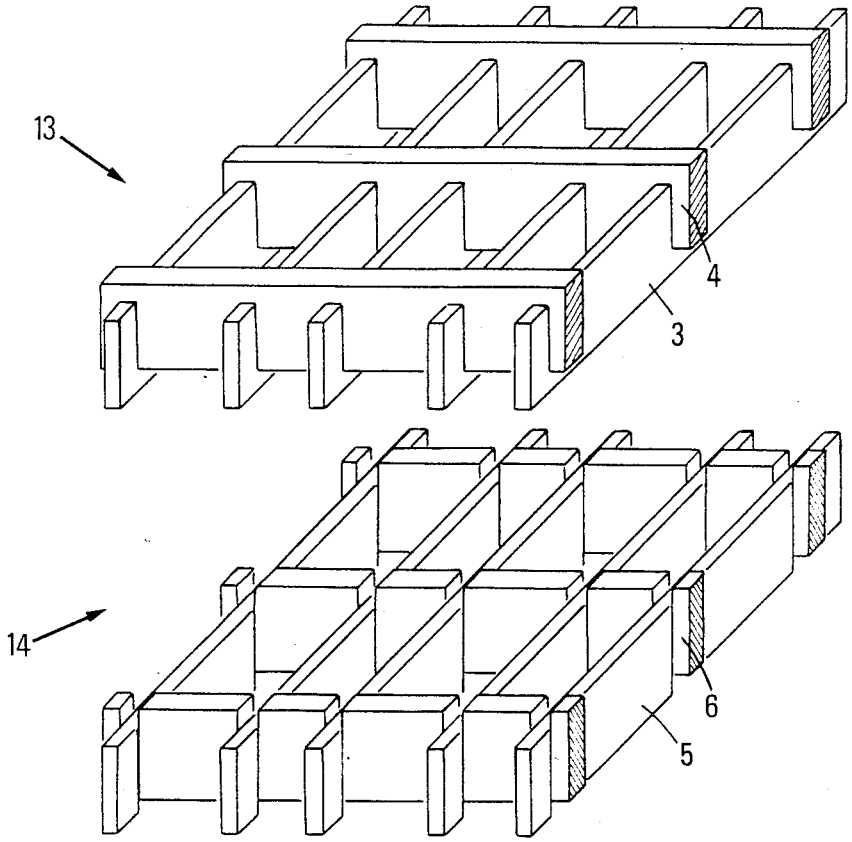
FIG. 5 shows a perspective view of two lattices of different types constituting a second embodiment of an analogous structure.
Figure 6B:
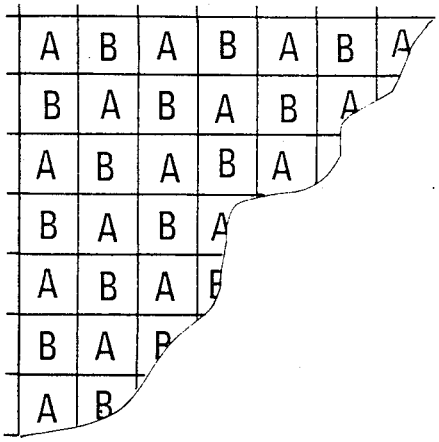

In the first case (solid small plates 28), the heat exchange structure obtained by assembling the different series of small plates consists only of vertical tubular channels, of rectangular or square cross-section, as already described hereabove in relation to FIG. 5. These channels can be fed with the fluids taking part of the exchange according to the distribution represented in FIG. 6A or 6B, the two fluids circulating co-current or counter-current.

In the second case (perforated small plates 28), the structure comprises rows of separate channels, alternating with spaces (or sections) wherein the different channels of the same row communicate with each other through the holes within the small plates called "perforated". This structure is equivalent to that shown in FIG. 1; it allows heat exchanges between fluids circulating in crossed streams.

The small plates which constitute the different heat exchange structures according to the invention can be made of various materials having good or moderate heat conductivity, depending on the temperatures of the fluids engaged in the heat exchange.

The material can consist of a thermoplastic material such as optionally charged polypropylene, for temperatures lower than 100° C., polyvinylidenefluoride, for temperatures of, for example, 100° to 140° C., or again a charged ethylene-tetrafluorethylene copolymer for temperatures ranging, for example, from 140° to 190° C.

The small plates can also consist of thermosetting plastics such as, for example, polyesters or epoxy resins.

The material can also consist of a metal, a metal alloy, glass, cement or ceramics. It can also consist of a composite material such as, for example, a plastic material charged with powdered, granular, fibrous, woven or unwoven products, said products or charges optionally consisting themselves of metals, alloys, amorphous carbon, graphite, glass, ceramics or inorganic salts.

Several embodiments of the small plates can be considered.

The small plates can first be cut from sheets of the selected material, the holes and cuts being made by machining (for example, boring, milling, sawing or grinding).

A second embodiment can consist of a molding or an injecting of the selected material, particularly when said material is a light alloy or a thermoplastic or thermosetting material.

As far as the assembling of the devices of heat exchange having the structures described in the invention is concerned, the mutual engagement of the series of small plates can be performed by mere mechanical engagement; it can also be made stronger or made tighter by brazing, galvanizing, soldering or sticking. The so-constituted lattices can also be assembled by mere mechanical engagement, which can be made stronger or made tighter by the above techniques.

Another embodiment can also consist of cutting the small plates from a metallic material (for example of light alloy) and coating them with a thermoplastic or thermosetting material before assembling.

Alternately, this coating can be performed on each of the already assembled lattices, before their stacking, or again on the already constituted exchange device of the invention.

The size of the devices of the invention can be selected at will: the small plates can have a length of a few centimeters up to several meters and a height of a few millimeters up to several decimeters. Each series can be made of a variable number of small plates, for example from about ten to several hundreds, and a variable number of series of small plates can be stacked, from about ten to several hundreds.

The exchange surface per unit volume of the devices conforming to the invention can be high. Average values of this surface are about 150 to 200 $m^2$ per $m^3$.

Finally, depending on the material constituting the exchanger of the invention, its massic surface can be about 6 to 7 $dm^2/kg$ for steel and about 40 to 50 $dm^2/kg$ for a plastic material.

What is claimed is:

1. A heat exchange device comprising at least one zone of modular structure, characterized in that said zone consists essentially of stacked lattices which can jointly engage above each other, each lattice being formed of intercrossing a first series and a second series of separate small plates contained in vertical planes, each plate having horizontal upper and lower edges, the small plates extending parallel to one another in the first series being jointly assembled by mutual engagement with the small plates extending parallel to one another in the second series by means of cuts located on at least one of the edges of the small plates of said first series and on the opposite edges of the small plates of said second series, said stacking generating spaces for circulating at least two fluids in heat exchange relationship.

2. A device according to claim 1, characterized in that said zone consists of the alternate stacking of lattices of two different types, the lattices of a first type (1) being such that the lower edges of the small plates (3) of said first series protrude from the lower side of said lattices (1) and the upper edges of the small plates (4) of said second series protrude from the upper side of said lattices (1), the lattices of a second type (2) being such that the upper edges of the small plates (5) of said first series stand recessed on the upper side of said lattices (2) and the lower edges of the small plates (6) of said second series stand recessed on the lower side of said lattices (2), the emergence of said protruding lower edges of the small plates (3) of said first series of said lattices of the first type (1) having the same height as the depression of said recessed upper edges of the small plates (5) of said first series of said lattices of the second type (2), and the emergence of said protruding upper edges of the small plates (4) of said second series of said lattices of the first type (1) having the same height as the depression of said recessed lower edges of the small plates (6) of said second series of said lattices of the second type (2).

3. A device according to claim 1, characterized in that the respective heights $h_1$ and $h_1'$ of the small plates (3) of said first series and of the small plates (4) of said second series of said lattices of the first type (1), the respective heights $h_2$ and $h_2'$ of the small plates (5) of said first series and of the small plates (6) of said second series of said lattices of the second type (2) and the respective depths $p_1$, $p_1'$, $p_2$ and $p_2'$ of the cuts located on the upper edges of said small plates (3), the lower edges of said small plates (4), the lower edges of said small plates (5) and the upper edges of said small plate (6) satisfy the equations:

$$p_1+p_1'+p_2+p_2'=h_1+h_2=h_1'+h_2'.$$

4. A device according to claim 3, characterized in that all the small plates (3), (4), (5) and (6) have the same height H and the depths of the cuts $p_1$, $p_1'$, $p_2$ and $p_2'$ satisfy the equation:

$$p_1+p_1'+p_2+p_2'=2H.$$

5. A device according to claim 1, useful as heat exchange zone for two fluids circulating cross-wise, characterized in that said small plates (3) and (5) of said first series of said lattices of the first type (1) and of said lattices of the second type (2) are solid and said small plates (4) and (6) of said second series of said lattices of the first type 1 and of said lattices of the second type (2) are perforated by holes located alternately, one out of two, in the solid parts of said small plates between two consecutive cuts, the superposition of said solid small plates (3) and (5), on the one hand, and of the solid parts of said perforated small plates (4) and (6), on the other hand, form rows of channels of rectangular or square cross-section, separated by the solid parts of said perforated small plates (4) and (6), a first fluid being able to flow through said rows of channels, and the superposition of said solid small plates (3) and (5), on the one hand, and of the perforated parts of said perforated small plates (4) and (6), on the other hand, forming spaces wherein the channels of rectangular or square cross-section communicate with each other through the holes within said perforated small plates (4) and (6), a second fluid being able to flow through said spaces.

6. A heat exchange device according to claim 5, characterized in that the end sides of the stacking through which said first fluid goes in and out are open with respect to said first fluid and closed with respect to said second fluid by plates (11) and (12) housed on the end sides and facing the spaces traversed by said second fluid, the two opposite sides of the stacking through which said second fluid goes in and out are open de facto with respect to the said second fluid through the holes within the perforated parts of said perforated small plates (4) and (6) whose superposition constitutes said sides and closed de facto with respect to said first fluid by the solid parts of said perforated small plates (4) and (6) whose superposition constitutes said sides, and the opposite sides of the stacking through which no fluid goes in or out are closed de facto by said solid small plates (3) and (5) whose superposition constitutes said sides.

7. A heat exchange device comprising at least one zone of modular structure, wherein said at least one zone comprises stacked lattices which jointly engage above one another and are each formed by intercrossing two series of separate small plates, wherein each lattice comprises:

a series of separate first plates having a predetermined lateral height and thicknesses and being arranged in first spaced parallel rows extending in a first direction; the series of first plates having upper edges and lower edges, the upper edges having a plurality of spaced notches therein, each of a predetermined depth and width;

a series of separate second plates having a predetermined lateral height and thicknesses complementing the widths of the notches of the first plates and being arranged in second, spaced parallel rows extending in a second direction different from the first direction; the series of second plates having upper edges and lower edges, the lower edges having a plurality of spaced notches therein of a width complementing the thickness of the first plates and a predetermined depth, the series of second plates nesting within the series of first plates with the notches of the second plates aligned with one another and interlocking the notches of the first plates; and with the bottom edges of the first plates extending below the bottom edges of the second plates and the top edges of the second plates extending above the top edges of the first plates, whereby the lattice formed by the first and second plate can nest with complementary lattices having notches therein for receiving the edges of the plates thereby forming paths for circulating at least two fluids in a heat transfer relationship.

8. The heat exchange device of claim 7 wherein each complementary lattice comprises:

a series of separate third plates having a predetermined lateral height and the same thickness as the first plates and being arranged in the same direction as the first plates; the series of third plates having upper edges and lower edges, the lower edges having a plurality of spaced notches therein of a width complementing the thickness of the second plates and a predetermined depth, and a series of fourth separate plates each having a predetermined lateral height and the same thickness as the second plates and being arranged in the same direction as the second plates; the series of fourth plates having upper edges and lower edges, the upper edges having a plurality of spaced notches therein of a width complementing the thickness of the first and third plates and a predetermined depth, the predetermined depth being substantially equal to the distance between the upper edge of the third plates and the bottom of the notches in the third plates plus the distance that the first plates project beyond the bottom edge of the second plates, when the first and second plates are nested with one another; wherein the subsequent lattice nests beneath the first lattice with the top edges of the subsequent lattice in abutment and line contact with the bottom edges of the first lattice.

9. The heat exchange device of claim 8, wherein the notches in the bottom edges of the third plates have a depth substantially equal to the distance between the bottom edges of the fourth plates and the bottom of the notches therein plus the distance that the second plates project above the top edges of the first plate, wherein the subsequent lattice is also nestable on the top of the first lattice with the bottom edges of the subsequent lattice in abutment and line contact with the top edges of the first lattice; whereby a stack of first and subsequent lattices may be configured to form a heat exchange device comprising many lattices.

10. The heat exchange device of claim 9 further including openings arranged in every other solid part located between adjacent notches of the second and fourth plates for providing communication between channels defined between walls created by alternating superposition of the second and fourth plates, in every other section defined between walls created by alternating superposition of the first and third plates, and further including sets of end plates having widths equal to the distances between every other pair of walls created by alternating superposition of the first and third plates for overlying the corresponding sections to define paths therewith for channelling fluid therethrough.

11. The heat exchange device of claim 10 wherein the openings in the second and fourth plates extent a substantial distance between the notches therein; wherein there is a projecting portion of each plate that projects a predetermined distance beyond the surfaces of the first and third plates; and wherein there are fifth and sixth end plates, the fifth end plates each having notches therein of a width to complement the thickness of the second plates and a depth equal to the predetermined distance of the projecting portion wherein each fifth end plate closes the space between two adjacent first plates, the sixth end plate having projections thereon of a width and length complementing the notches in the third plates and fitting between the third plates with the projections nesting in the notches of the third plates, wherein each sixth end plate closes the space between two adjacent third plates, whereby one fluid involved in the heat exchange flows in one direction parallel to the first and third plates, through the openings of the second and fourth plates, and another fluid involved in the heat exchange flows in a direction perpendicular to that of the first fluid through the spaces not closed by the fifth and sixth end plates.

12. The heat exchange device of claim 11 wherein the openings in the second and fourth plates are rectangular.

13. The heat exchange device of claim 11 wherein the openings extend from the edges of the plates inwardly wherein abutting second and fourth plates complement one another to form enlarged openings for the passage of heat exchange fluid.

14. The heat exchange device of claim 13 wherein the openings in each plates are semicircular.

15. The heat exchange device of claim 13 wherein the openings are triangular.

16. The heat exchange device of claim 13 wherein the openings are rectangular.

17. The heat exchange device of claim 11 wherein the openings are circular.

* * * * *